US006502506B2

(12) United States Patent
Endo et al.

(10) Patent No.: US 6,502,506 B2
(45) Date of Patent: Jan. 7, 2003

(54) STENCIL PRINTING MACHINE HAVING MOISTENER MECHANISM

(75) Inventors: Toshihiro Endo, Ibaraki-ken (JP); Yasuo Yamamoto, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/907,697

(22) Filed: Jul. 19, 2001

(65) Prior Publication Data

US 2002/0033104 A1 Mar. 21, 2002

(30) Foreign Application Priority Data

Jul. 28, 2000 (JP) ..... 2000-228779

(51) Int. Cl.[7] ..... B41L 13/04; B41L 23/02

(52) U.S. Cl. ..... 101/118; 101/114; 101/116; 101/416.1

(58) Field of Search ..... 101/114, 116, 101/117, 118, 119, 120, 129, 424.2, 416.1, 483, 487, 488

(56) References Cited

U.S. PATENT DOCUMENTS 3,877,371 A * 4/1975 Jaffa ..... 101/118
5,857,410 A * 1/1999 Watanabe et al. ..... 101/115
2002/0062747 A1 * 5/2002 Hashimoto et al. ..... 101/118

FOREIGN PATENT DOCUMENTS

JP 62-246729 * 10/1987
JP 6-134970 * 5/1994

* cited by examiner

*Primary Examiner*—Leslie J. Evanisko
(74) *Attorney, Agent, or Firm*—Gary M. Nath; Harold L. Novick; Marvin C. Berkowitz

(57) ABSTRACT

A stencil printing machine is provided with a paper feed section feeding a print sheet, which is allowed to have paper dusts thereon, in a paper feed path, and a print section to which the print sheet is transferred, and including a printing drum carrying thereon a stencil sheet having a perforated image area formed on the basis of image data and a rotary printing press member located in close proximity to an outer circumferential periphery of the printing drum to impart printing pressure thereto to allow the print sheet to be transferred in press contact between the printing drum and the rotary printing press member such that printing ink is transferred onto the print sheet to generate a desired image thereon through the perforated image area. There is further provided that a liquid applying mechanism applying liquid, which is permeable to the paper dusts, onto a print surface of the print sheet to allow the paper dusts to be permeated with the liquid at an upper stream position than a position where the printing drum and the rotary printing press member are in press contact with each other in the paper feed path. A liquid applying mechanism may firstly apply the liquid onto the stencil sheet from which the liquid is transferred to a print surface of the print sheet.

20 Claims, 5 Drawing Sheets

STENCIL PRINTING MACHINE HAVING MOISTENER MECHANISM

BACKGROUND OF THE INVENTION

The present invention relates to a stencil printing machine wherein a perforated stencil sheet is mounted onto a printing drum against which a print sheet is pressed during transfer thereof to allow ink to be transferred to the print sheet through a perforated area of the stencil sheet to generate a desired image thereon, and more particularly to a stencil printing machine effectively preventing paper dusts from being adhered to the stencil sheet mounted onto the printing drum.

Several researches and developments have been undertaken to provide a stencil printing machine of the type which enables printing with the use of a printing drum and a rotary back press roller, a typical example of which is disclosed in FIG. 9 which shows an essential part of a structure of the prior art stencil printing machine.

In FIG. 9, the stencil printing machine 10 includes a paper feed section 12 adapted to feed a print sheet S one by one from a stack of print sheets (not shown), and a print section 14 which enables printing on the print sheet S, which has been fed from the paper feed section 12, to reproduce a desired image thereon.

The paper feed section 12 includes plural paper feed roller pairs 12*a*, 12*b* which are arranged to be held in press contact with the print sheet S, creating frictional pressure during rotation of the roller pairs 12*a*, 12*b* to cause the print sheet S to be transferred to the print section 14 at predefined timings. The print section 14 includes a printing drum 16, and a back press roller 18 located in close proximity thereto and serving as a rotary printing press member for imparting printing pressure to the printing drum 16. In particular, the printing drum 16 and the back press roller 18 are rotatably supported under a condition wherein respective outer circumferential peripheries are partially located in substantially close proximity to one another. The printing drum 16 carries on its outer circumferential periphery a stencil clamping base 20 which clamps a leading edge of a stencil sheet 22. The stencil sheet 22 has a perforated image area or pattern which is formed by perforating with a thermal printing head based on image data. The outer circumferential periphery of the printing drum 16 also carries a flexible screen 24 over an area except for the stencil clamping base 20, with the flexible screen 24 being constituted with an ink permeable porous sheet. An inner press roller 26 is located inside the printing drum 16, which is moveable between a press contact position wherein the inner press roller 26 remains in press contact with an inner peripheral wall of the screen 24 and a wait position wherein the inner press roller 26 is held out of press contact with the inner peripheral wall of the screen 24. An outer periphery of the inner press roller 26 is supplied with ink, with the thickness of an ink layer adhered onto the inner press roller 26 being regulated with a gap formed by a doctor roller 28 to maintain the quantity of the ink to be applied to the screen 24 at a given constant level substantially at all times in the operation.

In the operation with such a structure, the perforated stencil sheet is made by perforating the stencil sheet 22 over a given area thereof on the basis of image data to produce a desired perforated area, and the perforated stencil sheet 22 is mounted onto the outer circumferential periphery of the printing drum 16. The printing drum 16, to which the stencil sheet 22 is mounted, is rotated in synchronism with the back press roller 18 as shown by an arrow in FIG. 9, with the print sheet S being transferred between the printing drum 16 and the back press roller 18 from the paper feed section 12. In this instance, the inner press roller 26 is moved to the press contact position to cause the screen 24, which adjacently has the stencil sheet 22, to be expanded outward during transfer of the print sheet S for thereby allowing the print sheet S to be held in press contact between the screen 24 and the back press roller 18 while transferring the print sheet S. During such a transfer step of the print sheet S in press contact with the screen 24 and the back press roller 18, the ink is transferred from the inside of the screen 24 to the print sheet S through the perforated area of the stencil sheet 22, reproducing the desired image on the print sheet S in dependence on the perforated area of the stencil sheet 22.

SUMMARY OF THE INVENTION

Due to further investigations performed by the present inventors, it is thought that the print sheet S encounters paper dusts that are produced due to friction caused with the paper feed roller pairs during travel thereof or paper dusts that are produced when the print sheet S has been cut and are adhered to the print sheet S. With such paper dusts adhered onto the print surface of the print sheet S, the paper dusts are transferred onto the stencil sheet 22 mounted onto the printing drum 16 when the print sheet S is pressed against the printing drum 16 such that the paper dusts are adhered to the stencil sheet 22. The paper dusts, that are separated from the print sheet S in a floating state, are adhered to the surface of the stencil sheet 22.

The paper dusts adhered to the stencil sheet 22 readily absorb the ink, thereby causing inadequate quantity of the ink to be transferred onto the print sheet S. As a result, the printed sheet S tends to have a thin area (i.e., a white area) of image corresponding to that of the stencil sheet adhered with the paper dusts. Also, in the event that the print sheet S and the paper dusts remaining thereon are sufficiently wet, a large quantity of the ink permeates into the paper dusts, and such ink is transferred onto the print sheet S. This causes the print sheet S to be transferred with more quantity of the ink than required, with the printed image being reproduced at more density in an area (i.e., a black area) corresponding to that of the stencil sheet adhered with the paper dusts than required.

That is, it is thought that, when the paper dusts are adhered to the stencil sheet 22 of the printing drum 16, the printed image are apt to involve the white and black areas, with a deteriorated quality in the printed image reproduced on the print sheet S. Such a deterioration in the print image becomes more conspicuous especially when the print section employs oily ink such as UV ink.

The present invention has been made through the above investigations by the present inventors and has an object to provide a stencil printing machine which prevents paper dusts from being adhered to a stencil sheet mounted onto a printing drum for thereby enabling a print sheet to be reproduced with a print image at a high quality.

According to one aspect of the present invention, there is provided a stencil printing machine which comprises: a paper feed section feeding a print sheet in a paper feed path, the print sheet being allowed to have paper dusts thereon; a print section to which the print sheet is transferred, and including a printing drum carrying thereon a stencil sheet having a perforated image area formed on the basis of image data and a rotary printing press member located in close proximity to an outer circumferential periphery of the printing drum to impart printing pressure thereto to allow the print sheet to be transferred in press contact between the printing drum and the rotary printing press member such that printing ink is transferred onto the print sheet to generate a desired image thereon through the perforated image area; and a liquid applying mechanism applying liquid, which is permeable to the paper dusts, onto a print surface of the print sheet to allow the paper dusts to be permeated with the liquid at an upper stream position than a position where the printing drum and the rotary printing press member are in press contact with each other in the paper feed path.

According to another aspect of the present invention, there is provided a stencil printing machine comprises: a paper feed section feeding a print sheet in a paper feed path, the print sheet being allowed to have paper dusts thereon; a print section to which the print sheet is transferred, and including a printing drum carrying thereon a stencil sheet having a perforated image area formed on the basis of image data and a rotary printing press member located in close proximity to an outer circumferential periphery of the printing drum to impart printing pressure thereto to allow the print sheet to be transferred in press contact between the printing drum and the rotary printing press member such that printing ink is transferred onto the print sheet to generate a desired image thereon through the perforated image area; and a liquid applying mechanism applying liquid, which is permeable to the paper dusts, onto the stencil sheet from which the liquid is transferred to a print surface of the print sheet to allow the paper dusts to be permeated with the liquid.

According to another aspect of the present invention, there is provided a stencil printing machine comprises: a paper feed section feeding a print sheet in a paper feed path, the print sheet being allowed to have paper dusts thereon; a print section to which the print sheet is transferred, and including a printing drum carrying thereon a stencil sheet having a perforated image area formed on the basis of image data and a rotary printing press member located in close proximity to an outer circumferential periphery of the printing drum to impart printing pressure thereto to allow the print sheet to be transferred in press contact between the printing drum and the rotary printing press member such that printing ink is transferred onto the print sheet to generate a desired image thereon through the perforated image area; and a liquid applying mechanism applying liquid, which is permeable to the paper dusts, onto a print surface of the print sheet to allow the paper dusts to be permeated with the liquid at a position where the printing drum and the rotary printing press member are in press contact with each other and/or at an upper stream position than the position where the printing drum and the rotary printing press member are in press contact with each other in the paper feed path.

Other and further features, advantages, and benefits of the present invention will become more apparent from the following description taken in conjunction with the following drawings.

DETAILED DESCRIPTION OF THE PREFERRED EMBODIMENT

To describe the present invention more in detail, preferred embodiments of the present invention will be explained with reference to the accompanied drawings below.

FIGS. 1 to 8 shows first to tenth preferred embodiments of a stencil printing machine according to the present invention, respectively. In respective preferred embodiments, in addition to the paper feed section 12 and print section 14 both of which have been already described in FIG. 9, a liquid applying mechanism is further provided. Incidentally, ink to be employed in the stencil printing machine is typically oily ink such as UV ink.

Figure 1:
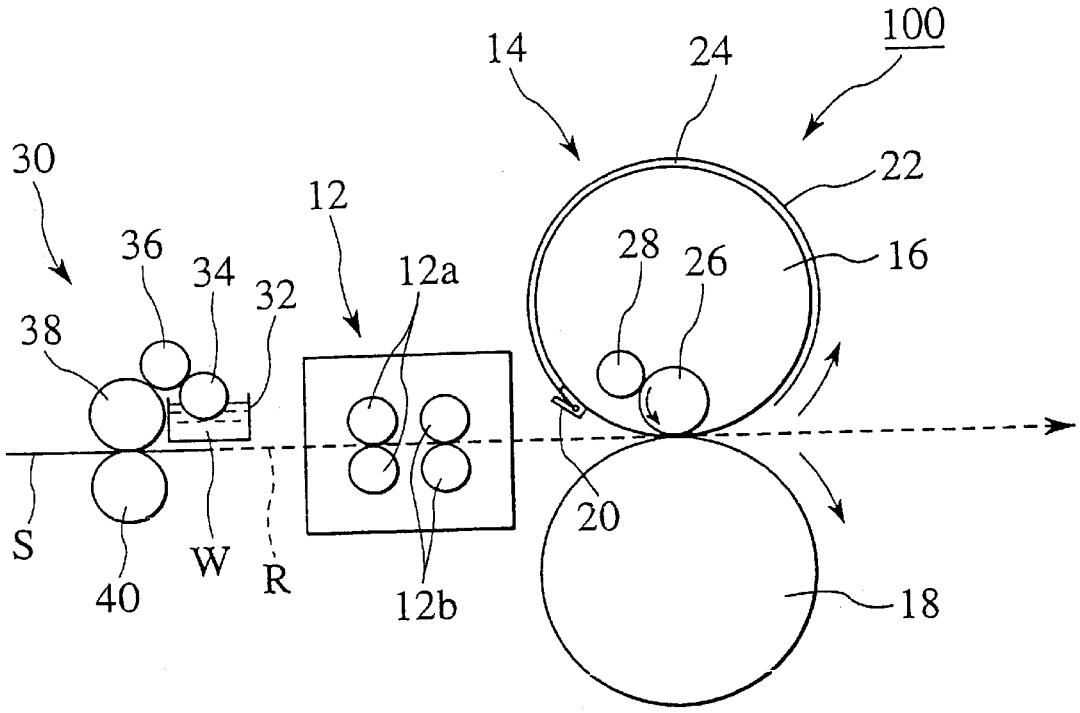
FIG. 1 is a schematic structural view of a first preferred embodiment of a stencil printing machine according to the present invention.

FIG. 1 schematically shows a structure of an essential part of a stencil printing machine of a first preferred embodiment according to the present invention.

As shown in FIG. 1, the stencil printing machine 100 includes a paper feed section 12 which feeds a print sheet S in a paper feed path R, a print section 14 and a liquid applying mechanism 30, which is located at an upstream side, in the paper feed path R, of the paper feed section 12.

The paper feed section 12 includes plural paper feed roller pairs 12*a*, 12*b* which are arranged to be held in press contact with the print sheet S, creating frictional pressure during rotation of the roller pairs 12*a*, 12*b* to cause the print sheet S to be transferred to the print section 14 at predefined timings. The print section 14 includes a printing drum 16, and a back press roller 18 located in close proximity thereto and serving as a rotary printing press member for imparting printing pressure to the printing drum 16. In particular, the printing drum 16 and the back press roller 18 are rotatably supported under a condition wherein respective outer circumferential peripheries are partially located in substantially close proximity to one another. The printing drum 16 carries on its outer circumferential periphery a stencil clamping base 20 which clamps a leading edge of a stencil sheet 22. The stencil sheet 22 has a perforated image area or pattern which is formed by perforating with a thermal printing head based on image data. The outer circumferential periphery of the printing drum 16 also carries a flexible screen 24 over an area except for the stencil clamping base 20, with the flexible screen 24 being constituted with an ink permeable porous sheet. An inner press roller 26 is located inside the printing drum 16, which is moveable between a press contact position wherein the inner press roller 26 remains in press contact with an inner peripheral wall of the screen 24 and a wait position wherein the inner press roller 26 is held out of press contact with the inner peripheral wall of the screen 24. An outer periphery of the inner press roller 26 is supplied with the ink, with the thickness of an ink layer adhered onto the inner press roller 26 being regulated with a gap formed by a doctor roller 28 to maintain the quantity of the ink to be applied to the screen 24 at a given constant level substantially at all times in the operation.

Further, the liquid applying mechanism 30 is constructed having a liquid tank 32 containing therein water W which is readily permeable to paper dusts, a rotatable liquid supply roller 34 which is immersed at its lower portion in the water W in the liquid tank 32, a liquid quantity adjustment roller 36 which is rotatably supported at a location separated from the liquid supply roller 34 with a given gap that can be adjusted at varying degrees to vary the quantity of the water to be adhered to an outer circumferential periphery of the liquid quantity adjustment roller 36, a rotatable liquid application roller 38 located in substantially close proximity to the liquid quantity adjustment roller 36, and a press roller 40 which is rotatably supported at a position to remain in press contact with the liquid application roller 38 via the paper feed path R.

With such a structure discussed above, during movement of the print sheet S in the paper feed path R between the liquid application roller 38 and the press roller 40, the liquid application roller 38 is held in press contact with a print surface of the print sheet S, thereby allowing the water W, which has been adhered to an outer periphery of the liquid application roller 38, to be transferred to the print surface of the print sheet S. When this occurs, the water W that is applied onto the print surface of the print sheet S from the liquid application roller 38 permeates through the paper dusts on the print sheet S, rendering the paper dusts to stick to the print sheet S with a strong force due to a surface tension created by the water W contained in the paper dusts. As a result, during transfer of the print sheet S from the paper feed section 12 with subsequent travel thereof in press contact with the screen 24 of the printing drum 16 and the back press roller 18, the paper dusts of the print sheet S are hard to stick to the stencil sheet 22. This causes the stencil sheet 22 of the printing drum 16 to be prevented from being undesirably adhered with the paper dusts, thereby rendering the stencil printing machine 100 to provide a printed image at high quality.

More specifically with such a structure, the perforated stencil sheet is made by perforating the stencil sheet 22 over a given area thereof on the basis of image data to produce a desired perforated area, and the perforated stencil sheet 22 is mounted onto the outer circumferential periphery of the printing drum 16. The printing drum 16, to which the stencil sheet 22 is mounted, is rotated in synchronism with the back press roller 18 as shown by an arrow in FIG. 1, with the print sheet S, to which the water W is applied, being transferred between the printing drum 16 and the back press roller 18 from the paper feed section 12. In this instance, the inner press roller 26 is moved to the press contact position to cause the screen 24, which adjacently has the stencil sheet 22, to be expanded outward during transfer of the print sheet S for thereby allowing the print sheet S to be held in press contact between the screen 24 and the back press roller 18 while transferring the print sheet S. During such a transfer step of the print sheet S in press contact with the screen 24 and the back press roller 18, the ink is transferred from the inside of the screen 24 to the print sheet S through the perforated area of the stencil sheet 22, reproducing the desired image on the print sheet S in dependence on the perforated area of the stencil sheet 22, while effectively preventing the paper dusts from adhering to the stencil sheet 22.

Accordingly, in the first preferred embodiment, since the stencil sheet 22 of the printing drum 16 is effectively prevented from being undesirably adhered with the paper dusts, a printed image at high quality can be actualized in the stencil printing machine 100.

Figure 2:
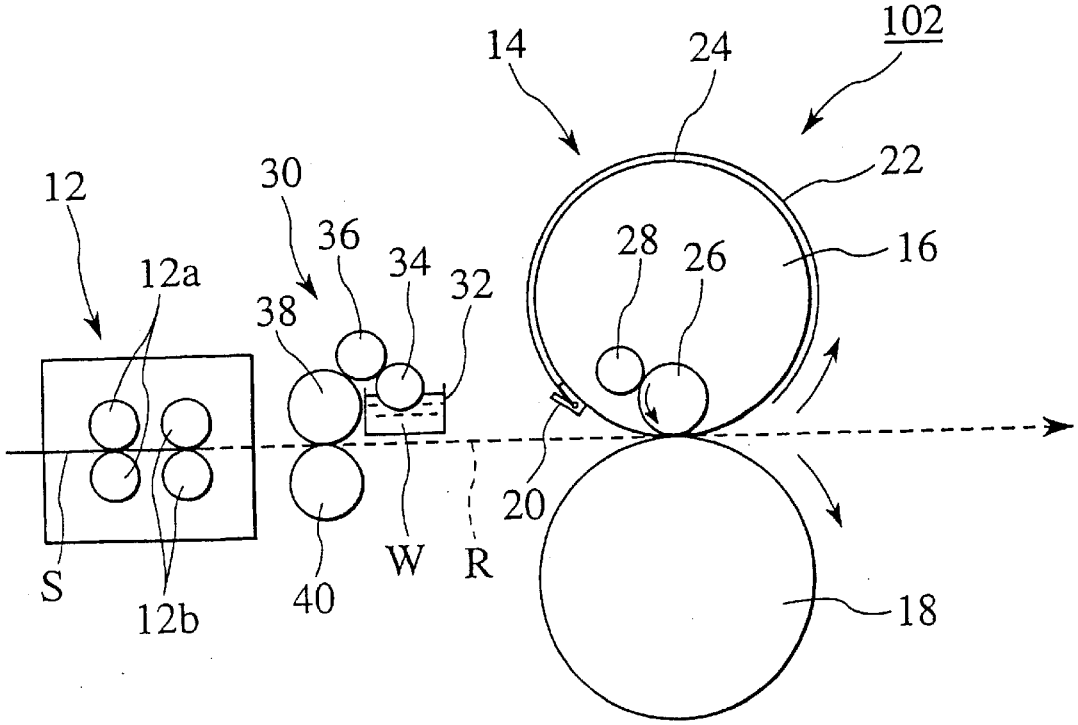
FIG. 2 is a schematic structural view of a second preferred embodiment of a stencil printing machine according to the present invention.

FIG. 2 schematically shows a structure of an essential part of a stencil printing machine 102 of a second preferred embodiment according to the present invention, with like parts bearing the same reference numerals as those used in FIG. 1 and duplicated description of the like parts being omitted for the sake of simplicity.

In the illustrated embodiment of FIG. 2, the liquid applying mechanism 30 of the stencil printing machine 102 is located at a position downstream of the paper feed section 12 in the paper feed path R thereof and upstream of a press contact position between the printing drum 5 and the back press roller 18 in the paper feed path R. That is, while, in the first preferred embodiment, the liquid applying mechanism 30 is located upstream of the paper feed section 12 in the paper feed path R, the second preferred embodiment features the provision of the liquid applying mechanism 30 in the paper feed path R between the paper feed section 12 and the printing section 14.

Accordingly, the second preferred embodiment substantially provides substantially the same operation and advantages as those of the first preferred embodiment. Also, in the second preferred embodiment, as the print sheet S contains the water W without any uneven wet area that would otherwise occur when the print sheet S travels through the paper feed section 12, it is possible to obtain a printed image with no unevenly transferred area of printing ink on the print sheet S. That is, the print sheet S can be fed to the print section 14 with an adequate quantity of the water W adhered to the print sheet S, thereby effectively preventing the whole area of the stencil sheet 22 of the printing drum 16 from being adhered with the paper dusts from the print sheet S in an effective manner.

Figure 3:
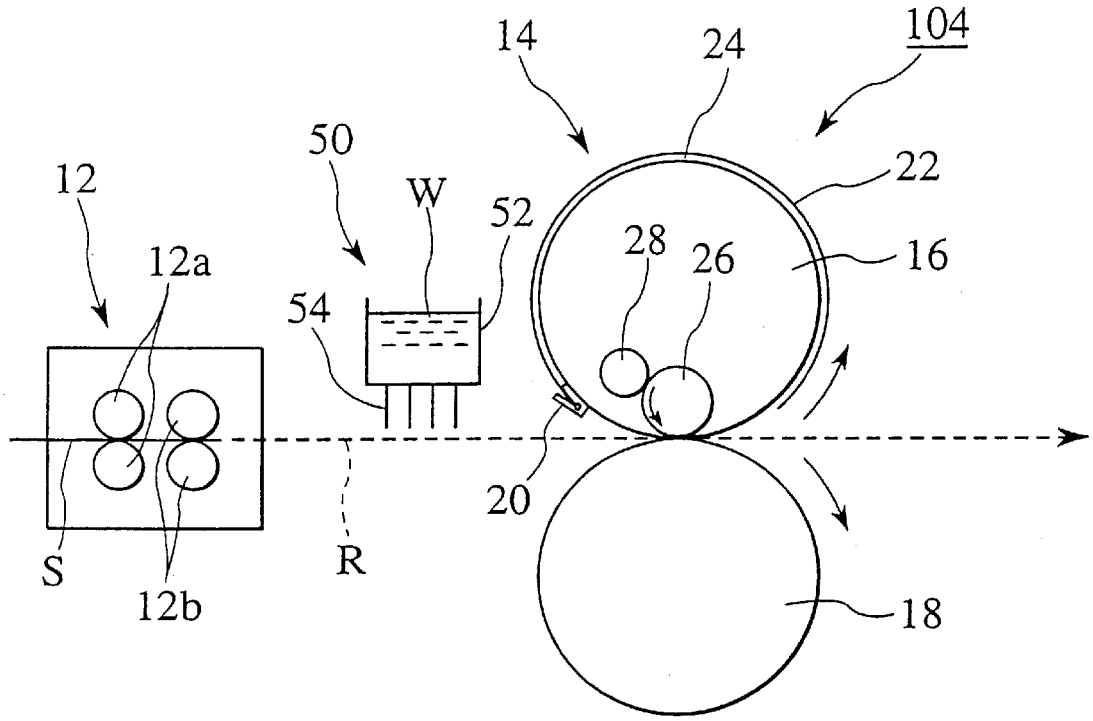
FIG. 3 is a schematic structural view of a third preferred embodiment of a stencil printing machine according to the present invention.

FIG. 3 schematically shows a structure of an essential part of a stencil printing machine 104 of a third preferred embodiment of the present invention, with like parts bearing the same reference numerals as those used in FIG. 1 and duplicated description of the like parts being omitted for the sake of simplicity.

As seen in FIG. 3, the stencil printing machine 104 includes a liquid applying mechanism 50 which is located in the same position as the second preferred embodiment and which is different in structure from that of the second preferred embodiment. The liquid applying mechanism 50 of the third preferred embodiment includes a the water tank 52 filled with the water W and a brush 54 which supplies the water W from the water tank 52 to the print sheet S. To this end, a terminal edge of the brush 54 is located above the paper feed path R. Note should be taken here that the quantity of the water W to be supplied to the brush 54 from the water tank 52 is suitably adjusted so as to apply the water W onto the print sheet S at an adjusted quantity.

With such a structure described above, during travel of the print sheet S at a location beneath the brush 54, the terminal edge of the brush 54 is brought into contact with the print surface of the print sheet S, thereby applying the water W, which has soaked through the brush 54, onto the print sheet S. Further, the water W, which has been applied to the print surface of the print sheet S from the brush 54, then permeates into the paper dusts on the print sheet S such that the paper dusts containing the water W strongly sticks to the surface of the print sheet S owing to surface tension of the water W. As a result, during transfer of the print sheet S from the paper feed section 12 with subsequent travel thereof in press contact with the screen 24 of the printing drum 16 and the back press roller 18, the paper dusts of the print sheet S are hard to stick to the stencil sheet 22.

Accordingly, in the third preferred embodiment too, the stencil sheet 22 of the printing drum 16 can be effectively prevented from being adhered with the paper dusts, thereby rendering the stencil printing machine 104 to provide a printed image at high quality.

Figure 4:
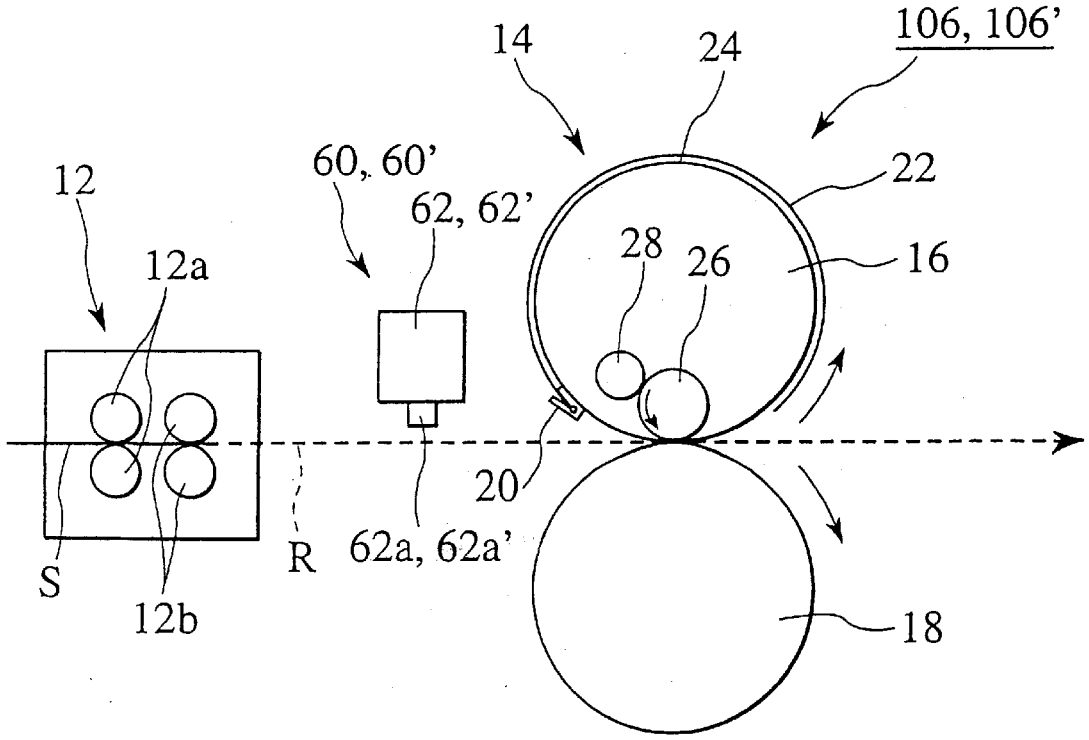
FIG. 4 is a schematic structural view illustrating fourth and fifth preferred embodiments of stencil printing machines according to the present invention.

FIG. 4 schematically shows a structure of an essential part of a stencil printing machine 106 of a fourth preferred embodiment of the present invention, with like parts bearing the same reference numerals as those used in FIG. 1 and duplicated description of the like parts being omitted for the sake of simplicity.

As seen in FIG. 4, the stencil printing machine 106 includes a liquid applying mechanism 60 which is located in the same position as the third preferred embodiment and which is different in structure from that of the third preferred embodiment. The liquid applying mechanism 60 of the fourth preferred embodiment includes a sprayer 62 which serves as a liquid sprayer for spraying the water W. To this end, a spray nozzle 62*a* is located above the paper feed path R to spray the water W thereto. Note should be taken here that the quantity of the water W to be sprayed is suitably adjusted so as to spray the water W onto the print sheet S at an adjusted quantity.

With such a structure described above, during travel of the print sheet S at a location beneath the sprayer 62, the spray nozzle 62*a* of the sprayer 62 is sprayed over the print surface of the print sheet S. Then, the water W which is sprayed over the print sheet S, permeates into the paper dusts on the print sheet S such that the paper dusts containing the water W strongly sticks to the print sheet S owing to surface tension of the water W. As a result, during transfer of the print sheet S from the paper feed section 12 with subsequent travel thereof in press contact with the screen 24 of the printing drum 16 and the back press roller 18, the paper dusts of the print sheet S are hard to stick to the stencil sheet 22.

Accordingly, in the fourth preferred embodiment too, the stencil sheet 22 of the printing drum 16 can be effectively prevented from being adhered with the paper dusts, thereby rendering the stencil printing machine 106 to provide a printed image at high quality.

Now, a stencil printing machine 106' according to a fifth preferred embodiment of the present invention is described with reference to FIG. 4 as a matter of convenience, with like parts bearing the same reference numerals as those used in FIG. 1 and duplicated description of the like parts being omitted for the sake of simplicity. In the fifth preferred embodiment, the liquid applying mechanism 60' comprises a humidifier 62' such as an ultrasonic humidifier that serves to spray the liquid. The humidifier 62' is located in a position to allow the spray nozzle 62*a'* to spray the water W toward the paper feed path R. Note should be taken here that the quantity of the water W to be sprayed by the humidifier 62' is suitably adjusted so as to spray the water W onto the print sheet S at an adjusted quantity.

Accordingly, in the fifth preferred embodiment too, the stencil sheet 22 of the printing drum 16 can be effectively prevented from being adhered with the paper dusts, thereby rendering the stencil printing machine 106' to provide a printed image at high quality.

Figure 5:
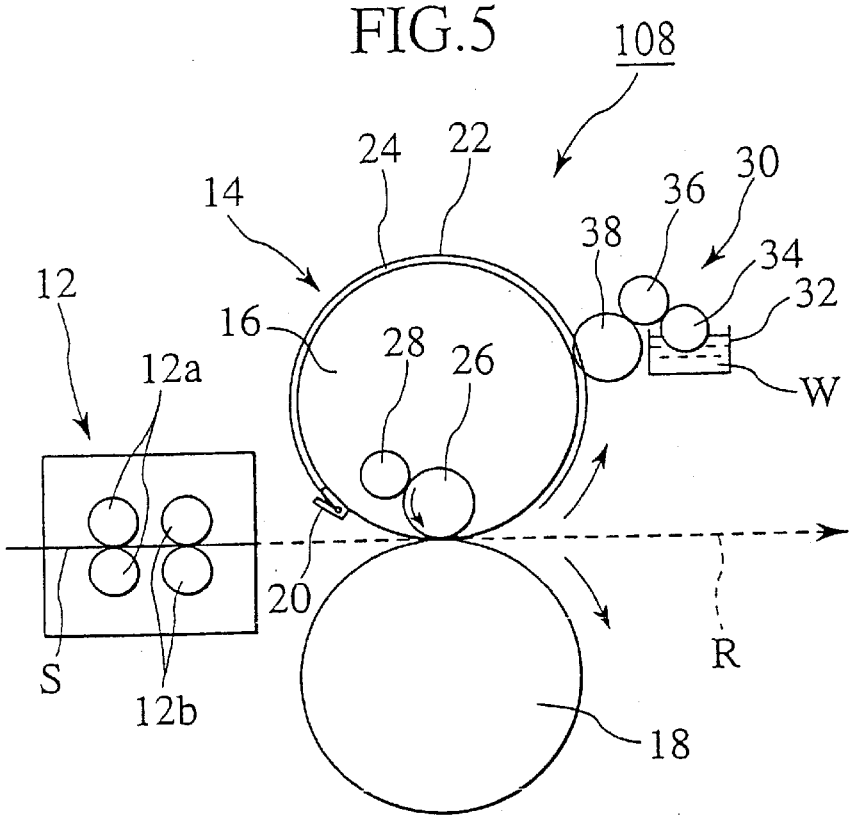
FIG. 5 is a schematic structural view of a sixth preferred embodiment of a stencil printing machine according to the present invention.

FIG. 5 schematically shows a structure of an essential part of a stencil printing machine 108 of a sixth preferred embodiment of the present invention, with like parts bearing the same reference numerals as those used in FIG. 1 and duplicated description of the like parts being omitted for the sake of simplicity.

As seen in FIG. 5, the liquid applying mechanism 30 is not located in the vicinity of the paper feed section 12 as in the first to fifth preferred embodiments but is located in the vicinity of an outer circumferential periphery of the printing drum 16 to apply the water W to a surface of the stencil sheet 22 mounted to the printing drum 16. The liquid applying mechanism 30 is identical in structure with the first and second preferred embodiments except that the press roller 40 is omitted, and, so, like parts bear the same reference numerals as those used in FIGS. 1 and 2 while duplicated description of these components being omitted for the sake of simplicity.

With such a structure discussed above, the printing drum 16 and the back press roller 18 are rotated at a synchronized speed during printing operation, with the stencil sheet 22 being rotated with the printing drum 16. In this instance, the liquid application roller 38 is held in press contact with the surface of the stencil sheet 22 and is rotated therewith, allowing the water W, which sticks to an outer circumferential periphery of the liquid application roller 38, to be transferred to the surface of the stencil sheet 22.

Then, the water W, which has been transferred to the surface of the stencil sheet 22 from the liquid application roller 38, is applied to the print surface of the print sheet S during its travel in press contact with the printing drum 16 and the back press roller 18. When this occurs, the water W transferred to the print sheet S soaks into the paper dusts on the print sheet S, thereby allowing the paper dusts, which contains the water W, to be strongly adhered to the print sheet S due to the surface tension of the water W. For this reason, during travel of the print sheet S, which has been fed from the paper feed section 12, in press contact with the stencil sheet 22 of the printing drum 16 and the back press roller 18, the paper dusts of the print sheet S hardly sticks to the stencil sheet 22.

Accordingly, in the sixth preferred embodiment too, the stencil sheet 22 of the printing drum 16 can be effectively prevented from being adhered with the paper dusts, thereby providing a printed image at high quality.

Figure 6:
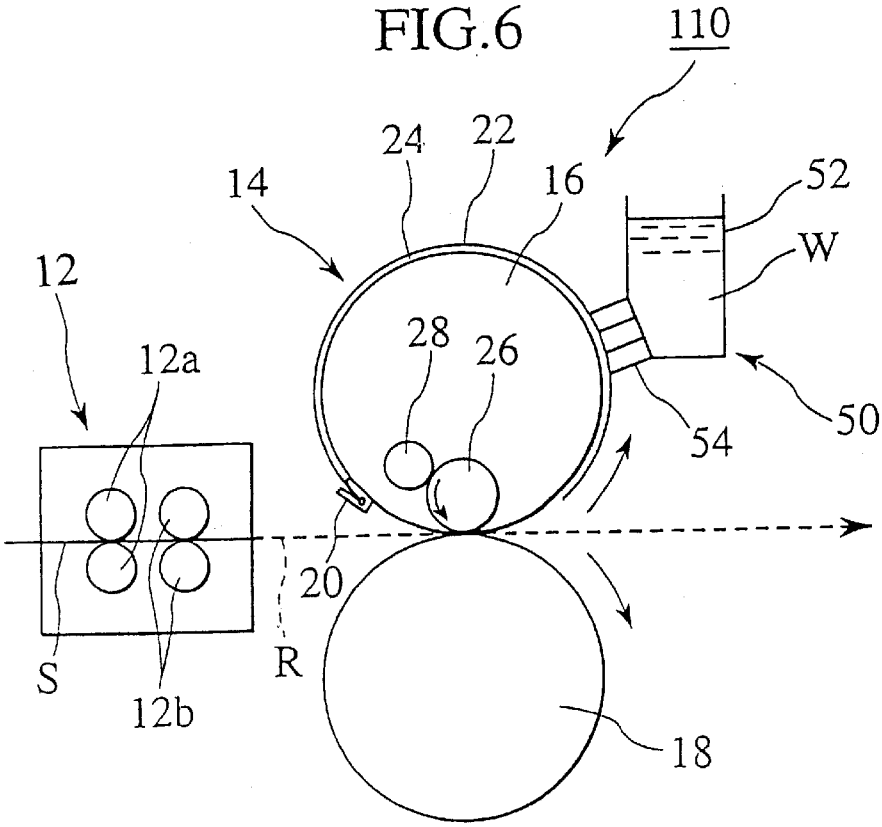
FIG. 6 is a schematic structural view of a seventh preferred embodiment of a stencil printing machine according to the present invention.

FIG. 6 schematically shows a structure of an essential part of a stencil printing machine 110 of a seventh preferred embodiment of the present invention, with like parts bearing the same reference numerals as those used in FIGS. 1 and 3 and a duplicated explanation of the like parts being omitted for the sake of simplicity.

As seen in FIG. 6, the liquid applying mechanism 50 is located in the same position as the sixth preferred embodiment but is different in structure from that of the fifth embodiment. More specifically, the liquid applying mechanism 50 forming a part of the seventh preferred embodiment is substantially identical in structure with that of the third preferred embodiment shown in FIG. 3, with like parts of the liquid applying mechanism 50 bearing the same reference numerals as those used in FIG. 3 and duplicated description of these components being omitted for the sake of simplicity.

With such a structure discussed above, the printing drum 16 and the back press roller 18 are rotated at the synchronized speed during printing operation, with the stencil sheet 22 being rotated with the printing drum 16. In this instance, when the stencil sheet 22 passes beneath the brush 54, allowing the water W adhered to the terminal edge of the brush 54 to be applied to the surface of the stencil sheet 22.

Then, the water W, which has been transferred to the surface of the stencil sheet 22, is applied to the print surface of the print sheet S during its travel in press contact with the printing drum 16 and the back press roller 18. When this occurs, the water W transferred to the print sheet S soaks into the paper dusts on the print sheet S like in the sixth preferred embodiment, thereby allowing the paper dusts, which contains the water W, to be strongly adhered to the print sheet S due to the surface tension of water W. For this reason, during travel of the print sheet S, which has been fed from the paper feed section 12, in press contact with the stencil sheet 22 of the printing drum 16 and the back press roller 18, the paper dusts of the print sheet S hardly sticks to the stencil sheet 22.

Accordingly, in the seventh preferred embodiment too, the stencil sheet 22 of the printing drum 16 can be effectively prevented from being adhered with the paper dusts, thereby providing a printed image at high quality.

Figure 7:
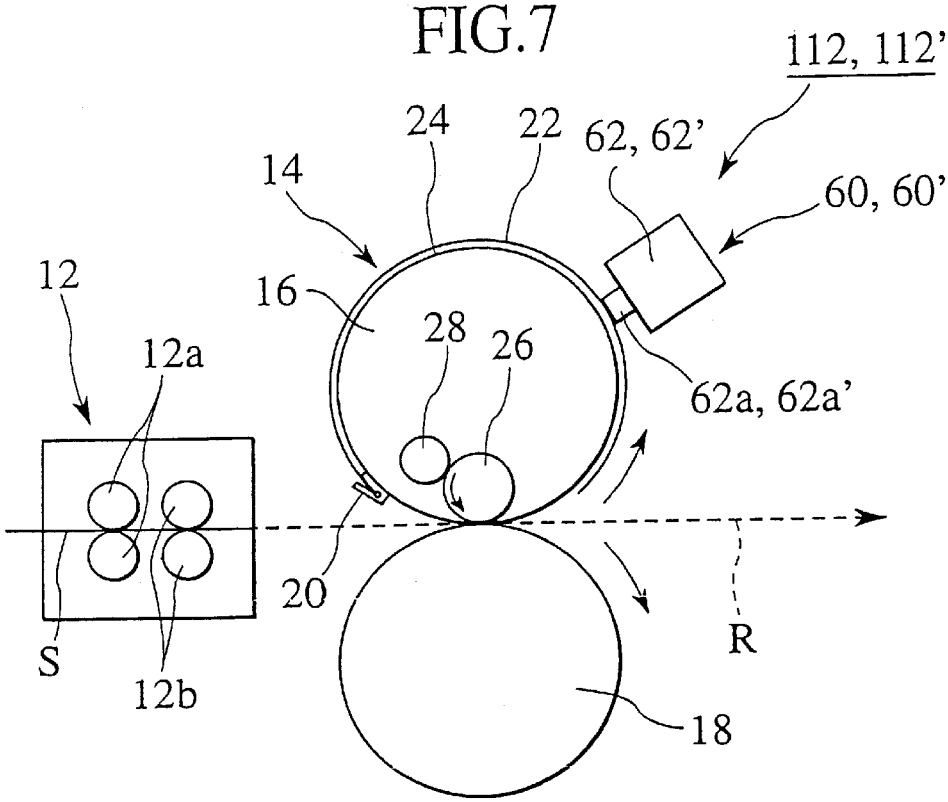
FIG. 7 is a schematic structural view illustrating eighth and ninth preferred embodiments of a stencil printing machine according to the present invention.

FIG. 7 schematically shows a structure of an essential part of a stencil printing machine 112 of an eighth preferred embodiment of the present invention, with like parts bearing the same reference numerals as those used in FIGS. 1 and 4 and a duplicated explanation of the like parts being omitted for the sake of simplicity.

As seen in FIG. 7, the liquid applying mechanism 60 is located in the same position as the sixth preferred embodiments but is different in structure from that of the sixth embodiment. More specifically, the liquid applying mechanism 60 forming part of the eighth preferred embodiment is substantially identical in structure with that of the fourth preferred embodiment shown in FIG. 4, with like parts of the liquid applying mechanism 60 bearing the same reference numerals as those used in FIG. 4 and duplicated description of these components being omitted for the sake of simplicity.

With such a structure discussed above, the printing drum 16 and the back press roller 18 are rotated at the synchronized speed during printing operation, with the stencil sheet 22 being rotated with the printing drum 16. In this instance, when the stencil sheet 22 passes beneath the sprayer 62, allowing the spray nozzle 62*a* of the sprayer 62 to spray the water W to the surface of the stencil sheet 22. Then, the water W, which has been transferred to the surface of the stencil sheet 22, is applied to the print surface of the print sheet S during its travel in press contact with the printing drum 16 and the back press roller 18. When this occurs, the water W transferred to the print sheet S soaks into the paper dusts on the print sheet S like in the sixth preferred embodiment, thereby allowing the paper dusts, which contains the water W, to be strongly adhered to the print sheet S due to the surface tension of water W. For this reason, during travel of the print sheet S, which has been fed from the paper feed section 12, in press contact with the stencil sheet 22 of the printing drum 16 and the back press roller 18, the paper dusts of the print sheet S hardly sticks to the stencil sheet 22.

Accordingly, in the eighth preferred embodiment too, the stencil sheet 22 of the printing drum 16 can be effectively prevented from being adhered with the paper dusts, thereby providing a printed image at high quality.

Now, a stencil printing machine 112' of a ninth preferred embodiment of the present invention is described with reference to,FIG. 7 as a matter of convenience. In the ninth preferred embodiment, the liquid applying mechanism 60' comprises a humidifier 62' of substantially the same structure as that of the fifth preferred embodiment shown in FIG. 4. The humidifier 62' is located in a position to allow the spray nozzle 62*a'* to spray the water W toward the stencil sheet 22. Note should be taken here that the quantity of the water W to be sprayed by the humidifier 62' is suitably adjusted so as to spray the water W onto the stencil sheet 22, that is, consequently onto the print sheet S through the stencil sheet 22 at an adjusted quantity.

Accordingly, in the fifth preferred embodiment too, the stencil sheet 22 of the printing drum 16 can be effectively prevented from being adhered with the paper dusts, thereby rendering the stencil printing machine 106' to provide a printed image at high quality.

Figure 8:
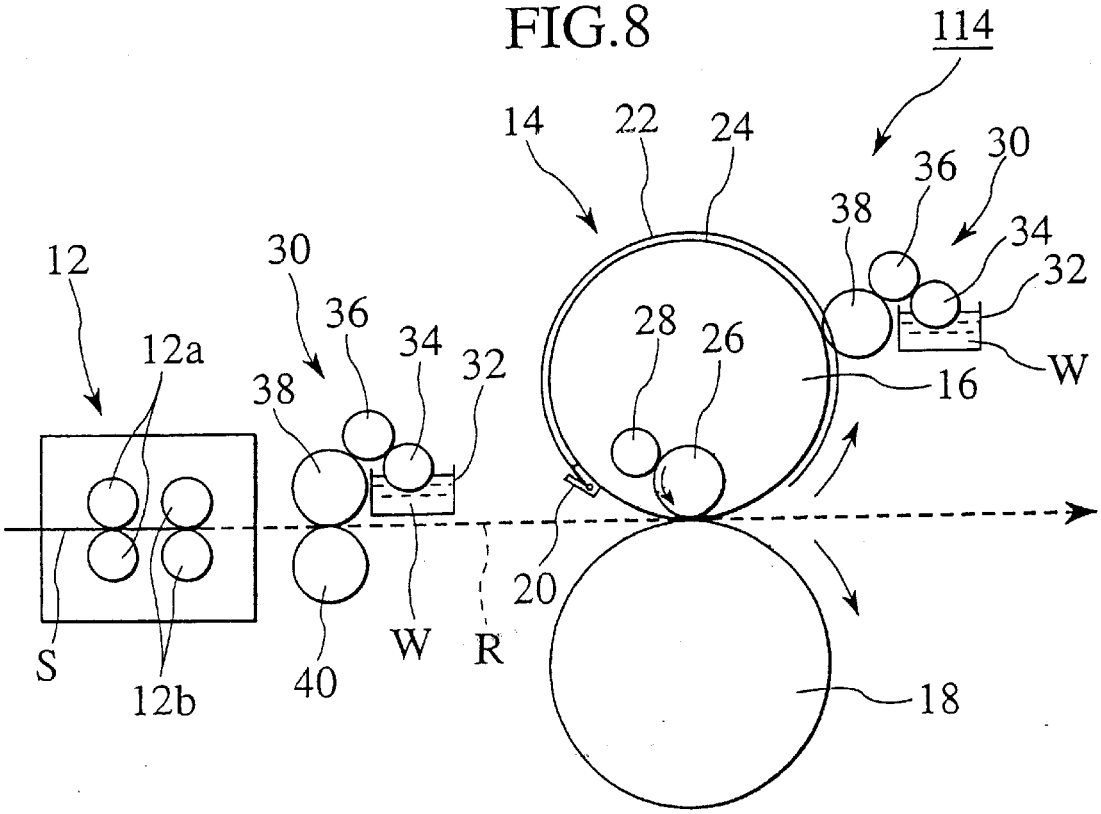
FIG. 8 is a schematic structural view of a tenth preferred embodiment of a stencil printing machine according to the present invention.
Figure 9:
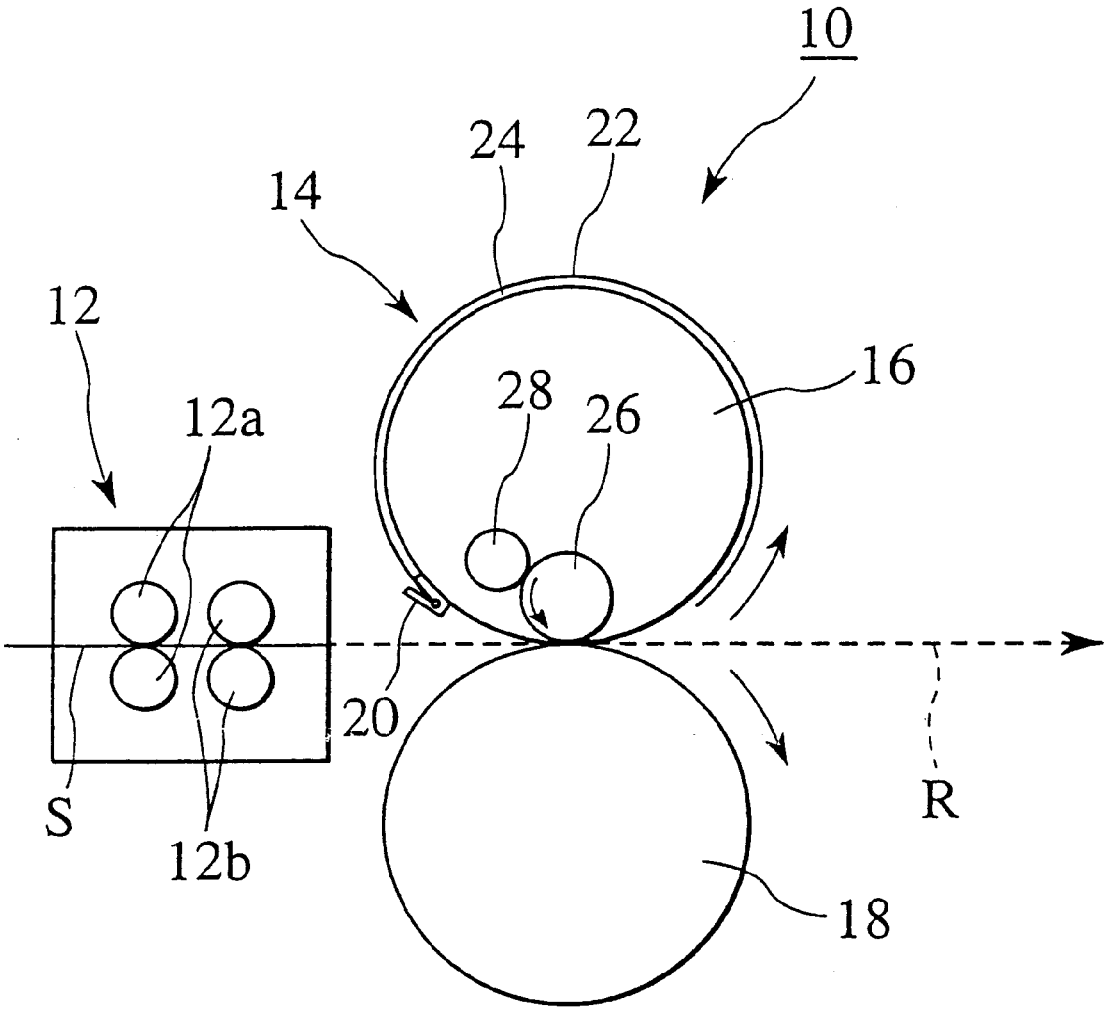
FIG.9 PRIOR ART
FIG. 9 is a schematic structural view of a prior art stencil printing machine.

FIG. 8 schematically shows a structure of an essential part of a stencil printing machine 114 of a tenth preferred embodiment of the present invention, with like parts bearing the same reference numerals as those used in FIGS. 1, 2 and 5 and a duplicated explanation of the like parts being omitted for the sake of simplicity.

As seen FIG. 8, the stencil printing machine 114 of the tenth preferred embodiment features a combination of the second preferred embodiment shown in FIG. 2 and the sixth preferred embodiment shown in FIG. 5. That is, the stencil printing machine 114 of the tenth preferred embodiment includes a first liquid applying mechanism 30 for applying the water W to the print surface of the print sheet S and a second liquid applying mechanism 30 for applying the water W to the surface of the stencil sheet 22.

Both the liquid applying mechanisms 30 are the same in structure as those of the second and sixth preferred embodiments shown FIGS. 2 and 5, respectively, with like parts bearing the same reference numerals as those used in FIGS. 2 and 5 and a duplicated explanation of the like parts being omitted for the sake of simplicity.

In the tenth preferred embodiments FIG. 8, the water W is directly applied to the print surface of the print sheet S, by means of the liquid applying mechanism 30,to which the water W is also indirectly applied, enhancing desired results in more reliable manner than the other preferred embodiments.

Incidentally in the tenth preferred embodiment, while both the liquid applying mechanisms 30 employ the water application rollers 38, respectively, the both of or either one of the liquid applying mechanisms 30 may comprise the brush 54, the sprayer 62 or the ultrasonic humidifier 62 each of which has been already described in detail.

While, in the first to third, sixth, seventh and tenth preferred embodiments, the liquid applying mechanisms 30, 50 are constructed of the liquid application roller 38 and the brush 54, respectively, to apply the water W to the print surface of the print sheet, resulting in direct contact with the print sheet S and the stencil sheet 22 to apply the water W thereto to allow the print surface of the print sheet to be uniformly applied with the water W in a highly reliable manner.

In the fourth, fifth, eighth and ninth preferred embodiment, the presence of the liquid applying mechanisms 60 constructed of the sprayer and the humidifier, respectively, which serve to apply the water W to the print sheet S enables indirect application of the water W to the print sheet S and the stencil sheet 22, respectively, in out of contact therewith without disturbing the transfer of the print sheet S and the rotation of the stencil sheet 22, respectively, in any event.

In the first, second, sixth and tenth preferred embodiments, the presence of the liquid applying means constructed of the liquid application roller 38 whose outer periphery carries thereon liquid allows the liquid application roller 38 to rotate with transfer of the print sheet S and with rotation of the stencil sheet 22 to apply the water W thereto, thereby preventing transfer of the print sheet S and rotation of the stencil sheet 22 from being disturbed as small as possible.

In the third and seventh preferred embodiments, the presence of the liquid applying means constructed of the brush 54 percolated with the water W allows the brush 54 to be located in contact with the print sheet S to be transferred and the stencil sheet 22 to be rotated, resulting in the liquid applying mechanism with a simplified structure.

In the first to tenth preferred embodiments, since the liquid applying mechanisms 30, 50 and 60 are arranged to enable control of the quantity of water application at varying degrees, it is possible for the liquid applying mechanisms to vary the quantity of the water (liquid) W to be applied to the print sheet S so as to correspondingly vary the quantity of the ink to be transferred thereto to provide a desired print density, allowing the print density to be reliably controlled. From experiments conducted as shown in he Table 1 which will be described later, it appears that control of the quantity of the water W to be applied and the quantity of the water W to be sprayed at respective optimum values provides similar effects discussed above.

In the second to fifth preferred embodiments and the tenth preferred embodiment, since the liquid applying mechanisms 30, 50 and 60 are located between the paper feed section 12, which feeds the print sheet S between the printing drum 16 and the back press roller 18 serving as the printing press applying member, and the ink transfer point wherein the print sheet S is pressed with the printing drum 16 and the back press roller 18 serving as the print press applying member, it is possible for the print sheet S to be evenly applied with liquid during transfer of the print sheet S through the paper feed section 12, thereby obtaining a desired print image without unevenly transferred ink. From experiments conducted as shown in Table 1 which will be described later, it appears that similar results are obtained in experimental tests conducted as shown therein.

In the first to tenth preferred embodiments, the presence of the water W to be employed as liquid in the liquid applying mechanisms 30, 50 and 60 provides ease of handling liquid to be employed in the liquid applying mechanisms 30, 50 and 60. Although it is preferred that liquid, to be employed in the liquid applying mechanisms 30, 50 and 60, should essentially have a permeable property relative to the paper dusts without causing deformation of the print sheet S while allowing quick evaporation, such as the water W and alcohol etc., the water is far desirable in view of handling property.

Here, from the experimental tests conducted for the first to tenth preferred embodiments and the prior art practice under a condition required for stencil printing operation, various results are obtained as shown in Table 1 that will be described in detail. The printing condition includes a speed of 150 sheets/minute; each print sheet S that is typically a Japanese official postal card; a print density of a normal value; and ink that is typically oily ink, with 300 sheets of the Japanese official post cards in each of which photo image is printed for evaluating the print image (such evaluation relates to white and black dots, unevenness and density feelings) with the eye. In the column "White and black areas", a symbol X designates that the print image contains a large amount of white and black dots, a symbol Δ designates that the print image contain a small amount of white and black dots, and a symbol ○ designates that the print image has substantially no white and black dots. In the column "Uneven area", a symbol Δ designates that the uneven area is less appeared, while a symbol ○ designating that there is substantially no uneven area. In the column "Density felling", a symbol Δ designates that the density feeling is thin, while a symbol ○ designating that there is substantially no thin feeling in the print density.

TABLE 1

| | Object to be applied or sprayed | Applying and spraying mechanism | Location to be applied or sprayed | Quantity of applying or spraying g/m$^2$ | White and black areas | Uneven area | Density feeling |
|---|---|---|---|---|---|---|---|
| Embodiment 1 | Print sheet | Roller | Front of paper feed | 5 | ○ | Δ | ○ |
| Embodiment 2 | Print sheet | Roller | Aft of paper feed | 0.5 | Δ | ○ | ○ |
| Embodiment 2 | Print sheet | Roller | Aft of paper feed | 5 | ○ | ○ | ○ |
| Embodiment 2 | Print sheet | Roller | Aft of paper feed | 50 | ○ | ○ | Δ |
| Embodiment 3 | Print sheet | Roller | Aft of paper feed | 5 | ○ | ○ | ○ |
| Embodiment 4 | Print sheet | Sprayer | Aft of paper feed | 5 | ○ | ○ | ○ |
| Embodiment 5 | Print sheet | Humidifier | Aft of paper feed | 0.5 | Δ | ○ | ○ |
| Embodiment 6 | Stencil master | Roller | — | 5 | ○ | ○ | ○ |
| Embodiment 7 | Stencil master | Brush | — | 5 | ○ | ○ | ○ |

TABLE 1-continued

| | Object to be applied or sprayed | Applying and spraying mechanism | Location to be applied or sprayed | Quantity of applying or spraying g/m$^2$ | White and black areas | Uneven area | Density feeling |
|---|---|---|---|---|---|---|---|
| Embodiment 8 | Stencil master | Sprayer | — | 0.5 | Δ | ○ | ○ |
| Embodiment 8 | Stencil master | Sprayer | — | 5 | ○ | ○ | ○ |
| Embodiment 8 | Stencil master | Sprayer | — | 50 | ○ | ○ | Δ |
| Embodiment 9 | Stencil master | Humidifier | — | 0.5 | Δ | ○ | ○ |
| Embodiment 10 | Print sheet, Stencil master | Roller, Roller | Aft of paper feed | 2.0 | ○ | ○ | ○ |
| Prior art practice | — | — | — | — | X | ○ | ○ |

Incidentally in the above embodiments 1 to 10, although the stencil printing machine employs the printing pressure applying mechanism provided with the back press roller 18, the stencil printing machine may preferably employ another type of member for imparting printing pressure to the print sheet S toward the printing drum 16.

Besides, with a view to reducing friction between the stencil sheet and a thermal printing head which is operated during a stencil making operation, the surface of the stencil sheet is apt to be applied with a separating agent such as wax, silicone oil etc. In the event that such a stencil sheet is employed in the present invention, since even when liquid is applied to the surface of the print sheet is brought into contact with the stencil sheet, liquid is repelled with the separating agent of the stencil sheet such that liquid is applied to the surface of the print sheet without being transferred to the stencil sheet. This causes the stencil sheet not to be adhered with the paper dusts, thereby providing an improved print image at a high quality. Further, in the event that the stencil sheet mounted to the printing drum is applied with liquid, it is possible for the print surface of the print sheet to be efficiently transferred with liquid, preventing the stencil sheet from being adhered with the paper dusts while obtaining the print image at higher quality.

The stencil printing machine of the present invention as described above in detail provide numerous advantages as typically summarized below.

The print quality can be greatly improved with no paper dusts sticking to the stencil sheet which has been mounted to the printing drum. This is due to the fact that the presence of the liquid applying mechanism enables liquid application to the print surface of the print sheet so as to cause the paper dusts, which remains on the print surface of the print sheet, to be percolated with liquid and strongly adhered to the surface of the print sheet owing to the surface tension of liquid for thereby preventing the paper dusts from sticking to the stencil sheet.

The liquid such as water is first applied to the stencil sheet by the liquid applying mechanism and is then transferred the print sheet from the stencil sheet during printing operation, allowing liquid to permeate into the paper dusts on the print sheet to cause the paper dusts to strongly stick to the print sheet owing to the surface tension of liquid percolated into the paper dusts. Thus, it is highly effective for the paper dusts to be prevented from being adhered to the stencil sheet of the printing drum, with a resultant print image at the higher quality.

The liquid such as water can be directly applied to the print sheet or the stencil sheet by the liquid applying mechanism, providing a uniform layer of liquid to be applied to the print surface of the print sheet in a highly reliable manner.

The liquid such as water can be applied to the print sheet or the stencil sheet by the liquid applying mechanism in non-contact therewith, preventing the transfer of the print sheet or the rotation of the stencil sheet from being disturbed.

The application of the liquid such as water can be implemented with the roller which rotates with the transfer of the print sheet or the rotation of the stencil sheet, preventing the transfer of the print sheet or the rotation of the stencil sheet from being disturbed as small as possible.

Since the brush, which is percolated with the liquid such as water, is simply located at a position so as to be held in contact with the print sheet to be transferred or the stencil sheet to be rotated, the liquid applying mechanism can be simplified in construction.

Since the quantity of the liquid such as water applied to the print sheet enables the quantity of the ink, which is transferred to the print sheet, to be varied, it is possible to variably adjust the quantity of the liquid to be applied to the print sheet so as to provide a desired print density, resulting in the print image with the print density substantially without causing any uneven transfer of the ink therein.

Since even during the transfer of the liquid such as water, which sticks to the print sheet, through the paper feed section, substantial no uneven thickness of the liquid exists on the print sheet, the print sheet is enabled to provide the print image which has no uneven transfer of the ink.

Even in the event that the oily ink is employed, since the paper dusts are not adhered to the surface of the stencil sheet, it is possible to obtain a printed material having a high quality.

The presence of the water as the liquid to be employed in the liquid applying mechanism allows the liquid to be handled in the liquid applying mechanism in a easy manner.

The entire content of a Patent Application No. TOKUGAN 2000-228779 with a filing date of Jul. 28, 2000 in Japan is hereby incorporated by reference.

Although the invention has been described above by reference to certain embodiments of the invention, the invention is not limited to the embodiments described above. Modifications and variations of the embodiments described above will occur to those skilled in the art, in light of the teachings. The scope of the invention is defined with reference to the following claims.

What is claimed is:

1. A stencil printing machine comprising:

a paper feed section adapted to feed a print sheet in a paper feed path, the print sheet being allowed to have paper dusts thereon;

a print section to which the print sheet is transferred, and which includes a printing drum carrying thereon a stencil sheet having a perforated image area formed on the basis of image data and a rotary printing press member located in close proximity to an outer circumferential periphery of the printing drum to impart printing pressure thereto to allow the print sheet to be transferred in press contact between the printing drum and the rotary printing press member such that printing ink is transferred onto the print sheet to generate a desired image thereon through the perforated image area; and a moistener mechanism adapted to evenly apply a moistening liquid, which is permeable to the paper dusts, onto a print surface of the print sheet to allow the paper dusts to be permeated with said moistening liquid at an upper stream position than a position where the printing drum and the rotary printing press member are in press contact with each other in the paper feed path.

2. A stencil printing machine according to claim 1, wherein the moistener mechanism is located upstream of the paper feed section in the paper feed path.

3. A stencil printing machine according to claim 1, wherein the moistener mechanism is located between the paper feed section and the print section in the paper feed path.

4. A stencil printing machine according to claim 1, wherein the moistener mechanism includes a source of moistening liquid and a liquid application roller mechanism rotatably located in contact with the print surface of the print sheet to apply the moistening liquid thereto from the liquid source.

5. A stencil printing machine according to claim 1, wherein the moistener mechanism includes a source of moistening liquid and a liquid application brush located in contact with the print surface of the print sheet to apply the moistening liquid thereto from the liquid source.

6. A stencil printing machine according to claim 1, wherein the moistener mechanism includes a sprayer having a spray nozzle located over the print surface of the print sheet to apply the moistening liquid thereto.

7. A stencil printing machine according to claim 1, wherein the moistener mechanism includes a humidifier having a spray nozzle located over the print surface of the print sheet to apply the moistening liquid thereto.

8. A stencil printing machine according to claim 1, wherein the moistener mechanism is adapted to adjust the quantity of moistening liquid to be applied to the print sheet.

9. A stencil printing machine according to claim 1, wherein the moistener mechanism is adapted to apply water as the moistening liquid.

10. A stencil printing machine according to claim 1, wherein the print section is adapted to use oily ink.

11. A stencil printing machine comprising:

a paper feed section adapted to feed a print sheet in a paper feed path, the print sheet being allowed to have paper dusts thereon;

a print section to which the print sheet is transferred, and which includes a printing drum carrying thereon a stencil sheet having a perforated image area formed on the basis of image data and a rotary printing press member located in close proximity to an outer circumferential periphery of the printing drum to impart printing pressure thereto to allow the print sheet to be transferred in press contact between the printing drum and the rotary printing press member such that printing ink is transferred onto the print sheet to generate a desired image thereon through the perforated image area; and a moistener mechanism adapted to evenly apply a moistening liquid, which is permeable to the paper dusts, onto the stencil sheet from which said moistening liquid is transferred to a print surface of the print sheet to allow the paper dusts to be permeated with said moistening liquid.

12. A stencil printing machine according to claim 11, wherein the moistener mechanism includes a source of moistening liquid and a liquid application roller mechanism rotatably located in the vicinity of the printing drum to apply the moistening liquid to the print sheet from the liquid source through the stencil sheet.

13. A stencil printing machine according to claim 11, wherein the moistener mechanism includes a source of moistening liquid and a liquid application brush located in the vicinity of the printing drum to apply the moistening liquid to the print sheet from the liquid source through the stencil sheet.

14. A stencil printing machine according to claim 11, wherein the moistener mechanism includes a sprayer having a spray nozzle located in the vicinity of the printing drum to apply the moistening liquid to the print sheet through the stencil sheet.

15. A stencil printing machine according to claim 11, wherein the moistener mechanism includes a humidifier having a spray nozzle located in the vicinity of the printing drum to apply the moistening liquid to the print sheet through the stencil sheet.

16. A stencil printing machine according to claim 11, wherein the moistener mechanism is adapted to adjust the quantity of moistening liquid to be applied to the print sheet.

17. A stencil printing machine according to claim 11, wherein the moistener mechanism is adapted to apply water as the moistening liquid.

18. A stencil printing machine according to claim 11, wherein the print section is adapted to use oily ink.

19. A stencil printing machine comprising:

a paper feed section adapted to feed a print sheet in a paper feed path, the print sheet being allowed to have paper dusts thereon;

a print section to which the print sheet is transferred, and which includes a printing drum carrying thereon a stencil sheet having a perforated image area formed on the basis of image data and a rotary printing press member located in close proximity to an outer circumferential periphery of the printing drum to impart printing pressure thereto to allow the print sheet to be transferred in press contact between the printing drum and the rotary printing press member such that printing ink is transferred onto the print sheet to generate a desired image thereon through the perforated image area; and a moistener mechanism adapted to evenly apply a moistening liquid, which is permeable to the paper dusts, onto a print surface of the print sheet to allow the paper dusts to be permeated with said moistening liquid at a position where the printing drum and the rotary printing press member are in press contact with each other or at an upper stream position than the position where the printing drum and the rotary printing press member are in press contact with each other in the paper feed path.

20. A stencil printing machine comprising:

a paper feed section adapted to feed a print sheet in a paper feed path, the print sheet being allowed to have paper dusts thereon;

a print section to which the print sheet is transferred, and which includes a printing drum carrying thereon a stencil sheet having a perforated image area formed on the basis of image data and a rotary printing press member located in close proximity to an outer circumferential periphery of the printing drum to impart printing pressure thereto to allow the print sheet to be transferred in press contact between the printing drum and the rotary printing press member such that printing ink is transferred onto the print sheet to generate a desired image thereon through the perforated image area; and a liquid applying mechanism adapted to evenly apply a liquid, which is to be transparent on the print sheet and permeable to the paper dusts, onto a print surface of the print sheet to allow the paper dusts to be permeated with the liquid at a position where the printing drum and the rotary printing press member are in press contact with each other or at an upper stream position than the position where the printing drum and the rotary printing press member are in press contact with each other in the paper feed path.

* * * * *